US010488806B2

(12) United States Patent
Hagimoto

(10) Patent No.: US 10,488,806 B2
(45) Date of Patent: Nov. 26, 2019

(54) CLEANING BLADE AND IMAGE FORMING APPARATUS

(71) Applicant: KONICA MINOLTA, INC., Chiyoda-ku, Tokyo (JP)

(72) Inventor: Noritoshi Hagimoto, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 3 days.

(21) Appl. No.: 15/704,894

(22) Filed: Sep. 14, 2017

(65) Prior Publication Data

US 2018/0081318 A1 Mar. 22, 2018

(30) Foreign Application Priority Data

Sep. 20, 2016 (JP) ..... 2016-182484

(51) Int. Cl.
*G03G 21/00* (2006.01)

(52) U.S. Cl.
CPC ..... *G03G 21/0029* (2013.01)

(58) Field of Classification Search
CPC ..... G03G 21/007; G03G 21/0011; G03G 21/0017; G03G 21/0029; G03G 2221/0005; G03G 2221/0026; G03G 2221/0068; G03G 2221/0089; G03G 2221/1618; G03G 2221/1627
See application file for complete search history.

(56) References Cited

U.S. PATENT DOCUMENTS

2010/0054831 A1* 3/2010 Sakanobe ..... G03G 21/0029 399/351
2013/0236218 A1* 9/2013 Inagaki ..... G03G 15/0131 399/302
2014/0193172 A1* 7/2014 Tawada ..... G03G 21/0029 399/111
2017/0269538 A1* 9/2017 Murauchi ..... G03G 21/0011

FOREIGN PATENT DOCUMENTS

JP 2007323026 A 12/2007
JP 2008102322 A 5/2008
JP 2008111972 A 5/2008

OTHER PUBLICATIONS

JP 2007323026 English machine translation, Ariizumi, Dec. 13, 2007.*

* cited by examiner

*Primary Examiner* — Thomas S Giampaolo, II
(74) *Attorney, Agent, or Firm* — Holtz, Holtz & Volek PC

(57) ABSTRACT

A cleaning blade that removes a substance adhering to a surface of a rotating image carrier, includes: a contact member having elasticity for removing the substance; a blade spring member that is provided with the contact member on a first end of the blade spring member and presses the contact member onto the surface of the image carrier; and a support member that fixes and supports a second end of the blade spring member, wherein the blade spring member protrudes from a first edge of the support member by a protrusion length of L (mm), and when a distance from the first edge to a fixed position at which the blade spring member is fixed on the support member is d (mm), the length L is equal to or longer than 10 mm and equal to or shorter than 20 mm and $1/10 \leq d/L \leq 1/3$ (1) is satisfied.

11 Claims, 6 Drawing Sheets

CLEANING BLADE AND IMAGE FORMING APPARATUS

Japanese Patent Application No. 2016-182484 filed on Sep. 20, 2016, including description, claims, drawings, and abstract the entire disclosure is incorporated herein by reference in its entirety.

BACKGROUND

Technological Field

The present invention relates to a cleaning blade including a contact member and an image forming apparatus including the cleaning blade.

Description of the Related Art

In general, contact members of cleaning blades have been made of polyurethane elastomers. Such a contact member made of polyurethane elastomers has a high cleaning capability. However, pressure for bringing the contact member into contact with an image carrier such as a photoreceptor is constantly applied to the contact member, and this constant pressure tends to cause the permanent deformation (fatigue) of the contact member. The permanent deformation of the contact member reduces the contact pressure onto the image carrier and thus causes faulty cleaning.

In anticipation of such deterioration of polyurethane elastomers with time, the contact pressure is initially increased so that the contact pressure is maintained as necessary at the end of the life of the contact member. However, such increased pressure causes the increase in torque of the image carrier.

Furthermore, polyurethane elastomers vary drastically, depending on the environment. The contact pressure applied to the image carrier increases in a high-temperature environment. This increased contact pressure directly causes the increase in torque of the image carrier. On the other hand, the contact pressure applied to the image carrier decreases in a low-temperature environment. This decreased contact pressure tends to cause faulty cleaning. In order to maintain the necessary contact pressure in a low-temperature environment, it is necessary to increase a median contact pressure designed. This causes the increase in torque of the image carrier.

Furthermore, due to the characteristics of polyurethane elastomers, an edge which is in contact with the image carrier is pulled and deformed toward the downstream of the rotation of the image carrier. This increases the peak pressure (=the contact pressure (N/m)/the nip width). Such a condition increases the torque that rotates and drives the image carrier.

For example, each of JP 2008-102322 A, JP 2007-323026 A, and JP 2008-111972 A proposes a cleaning blade including a contact member that is supported by a metal blade spring member and is in contact with an image carrier. This can set the initial contact pressure at an optimal value and decrease the torque of the image carrier. Furthermore, the contact force of the contact member seldom varies with the environment variations. Thus, an optimal contact pressure can be set. Furthermore, an elastic body, for example, made of polyurethane elastomers adheres to the hard metal blade spring member. This reduces the deformation of the elastic body as a whole and reduces the deformation of the edge of the contact member pulled toward the downstream of the rotation of the contact member as the existing contact member. This enables the contact member to be in contact with and clean the image carrier while the image carrier has low torque.

However, a first end of the blade spring member is provided with the contact member and a second end of the blade spring member needs to be fixed on a support member. It has been found that there may be a new disadvantage, depending on the fixed position at which the blade spring member is fixed on the support member. When the fixed position at which the blade spring member is fixed on the support member is far away from a first edge of the support member, the blade spring member may be deformed in a region between the fixed position and the first of the support member. When the blade spring member is deformed in the region, the whole contact member is pulled toward the downstream of the rotation of the image carrier. This increases the contact pressure, and the contact angle, and thus increases the peak pressure. This increases the torque of the image carrier, and thus wears the image carrier more and leads to the reduction in life of the image carrier. On the other hand, when the fixed position at which the blade spring member is fixed on the support member is placed near the first edge of the support member, strong force is applied to the fixed part and the fixed part is peeled, or the blade spring member is deformed beyond the yield point and damaged.

SUMMARY

In light of the foregoing, an object of the present invention is to provide a cleaning blade which does not cause the increase in torque of the image carrier, and the reduction in life of the image carrier, does not causes the separation of the blade spring member from the support member and the damage to the blade spring member, and can reduce the permanent deformation of the contact member.

To achieve the abovementioned object, according to an aspect of the present invention, a cleaning blade that removes a substance adhering to a surface of a rotating image carrier, reflecting one aspect of the present invention comprises: a contact member that is formed into a rectangular shape with a width corresponding to a length perpendicular to a rotation direction in which the image carrier rotates and has elasticity for removing the substance adhering to the surface of the image carrier by sliding on the surface of the image carrier, a blade spring member that is provided with the contact member on a first end of the blade spring member and presses the contact member onto the surface of the image carrier, and a support member that fixes and supports a second end of the blade spring member, wherein the blade spring member protrudes from a first edge of the support member by a protrusion length of L (mm), and when a distance on the support member from the first edge of the support member to a fixed position at which the blade spring member is fixed on the support member is d (mm), the protrusion length L of the blade spring member from the first edge of the support member is equal to or longer than 10 mm and equal to or shorter than 20 mm and a following inequality (1) holds:

$$1/10 \leq d/L \leq 1/3 \quad (1).$$

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
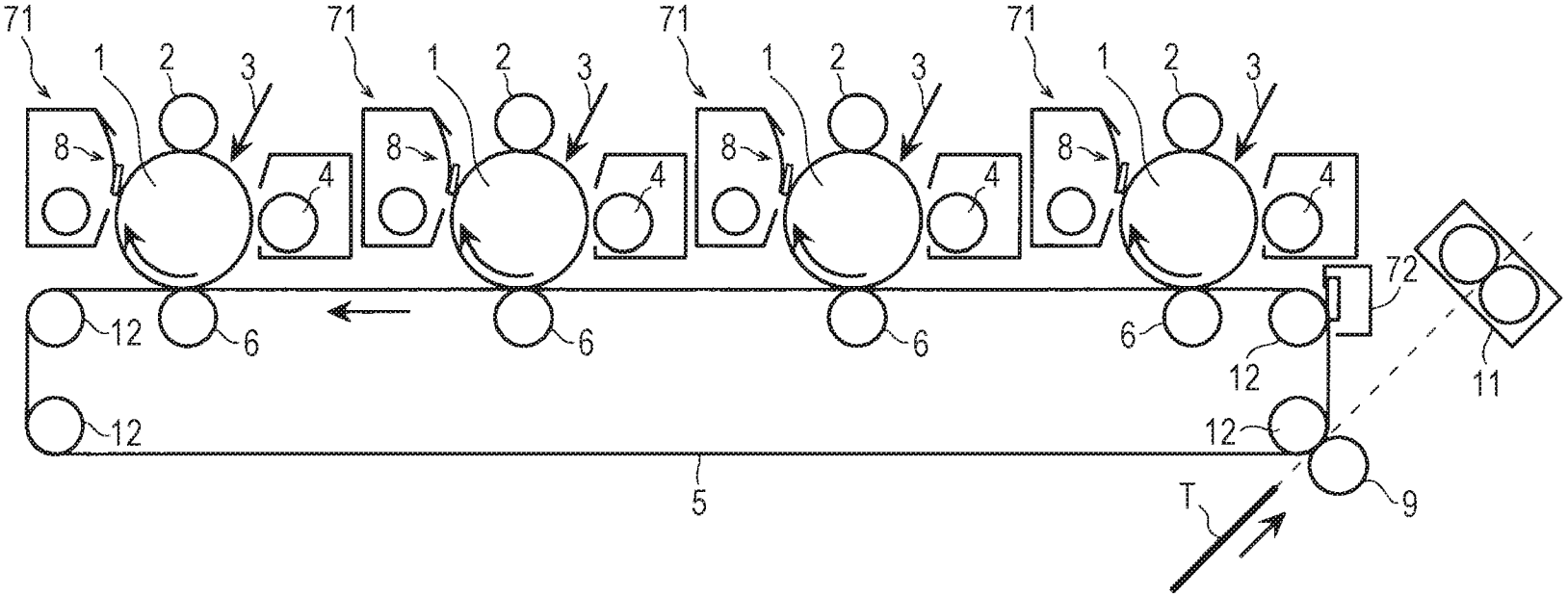
FIG. 1 is a schematic diagram of a configuration of an exemplary image forming apparatus according to an embodiment of the present invention.

FIG. 1 is a schematic diagram of a configuration of main parts of a full-color tandem electrographic image forming apparatus for an electrographic process, including a cleaning blade according to an embodiment of the present invention. The image forming apparatus forms an image by forming a toner image on a photoreceptor 1 with an electrographic image forming process and transferring and fixing the toner image onto a recording medium T such as a sheet of paper.

The image forming apparatus includes the photoreceptor 1 that forms and carries an electrostatic latent image thereon. A charger 2 for evenly charging the surface of the photoreceptor 1, an exposer 3 for forming an electrostatic latent image by exposing a part of the surface of the photoreceptor 1 which corresponds to the image, a development device 4 that develops the electrostatic latent image on the photoreceptor 1 with the charged toner using the effect of the force of the electric field, a primary transfer roller 6 that transfers the toner image formed on the photoreceptor 1 onto a transfer belt 5 using the effect of the force of the electric field, and a photoreceptor cleaning device 71 that removes the remaining transfer toner on the photoreceptor 1 are arranged around the photoreceptor 1 in the order along the direction in which the photoreceptor 1 rotates.

The transfer belt 5 is given predetermined belt tension and supported by four support rollers 12 arranged as four corners. One of the four support rollers 12 is driven by and connected with the body of the image forming apparatus. A secondary transfer roller 9 that transfers the toner image, the toner image is images of a plurality of colors overlaid and transferred on the transfer belt 5, onto a recording medium T using the effect of the force of the electric field is placed at a downstream position of the travel of the transfer belt 5 after the primary transfer roller 6 of each color. The toner image transferred on the recording medium T is heated and pressed with a fixer 11 and fixed on the recording medium T. The remaining transfer toner on the transfer belt 5 is removed from the transfer belt 5 by a transfer belt cleaning device 72. Note that, for example, the photoreceptor, the charger, the exposer, the development device, the cleaning device, the transcriber, and the fixer used in the electrographic image forming apparatus may arbitrarily select and use publicly known electrographic technologies. The number of the support rollers 12 supporting the transfer belt 5 is not limited to four, and a plurality of support rollers 12 are required.

Figure 2:
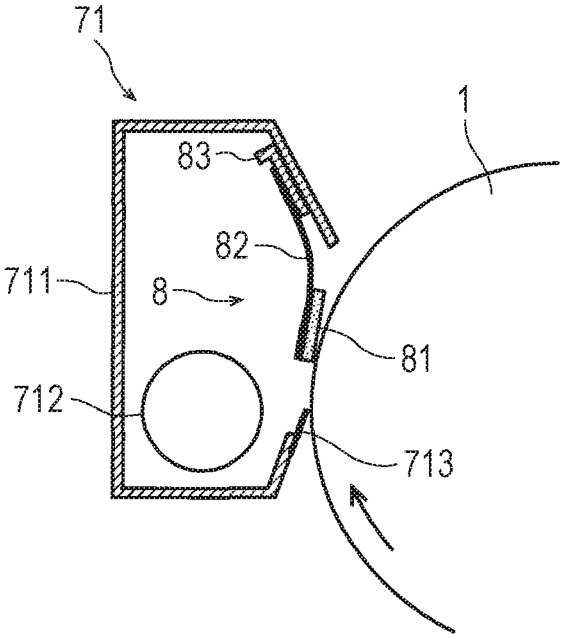
FIG. 2 is a schematic diagram of a configuration of a photoreceptor cleaning device of the image forming apparatus illustrated in FIG. 1.

FIG. 2 is a schematic diagram of a configuration of the photoreceptor cleaning device 71. The photoreceptor cleaning device 71 includes an opening on a surface facing the photoreceptor 1, a housing 711 having a length equal to or longer than an image forming region in a direction of the axis of the photoreceptor 1, a cleaning blade 8 that removes a substance such as the remaining transfer toner adhering to the surface of the photoreceptor 1, a conveyance screw 712 that conveys the substance that the cleaning blade 8 removes from the surface of the photoreceptor 1 to a toner waste containing box (not illustrated), and a seal member 713 that seals the gap between the housing 711 and the photoreceptor 1 to prevent, for example, toner waste from scattering from the opening of the housing 711 to the outside. Note that, although the cleaning blade 8 illustrated in FIG. 2 removes a substance adhering to the photoreceptor 1 that is an image carrier, the cleaning blade according to an embodiment of the present invention may be used also to remove a substance adhering to the surface of the transfer belt 5 that is an image carrier.

The cleaning blade 8 includes a contact member 81 having a rectangular shape and elasticity, a blade spring member 82 provided with the contact member 81 on a first end of the blade spring member 82, and a support member 83 fixing and supporting a second end of the blade spring member 82. A distance between the cleaning blade 8 and the photoreceptor 1 is determined according to the attachment position and attachment angle at which the support member 83 is attached to the housing 711. Furthermore, a free length of the blade spring member 82 is determined according to the attachment position at which the blade spring member 82 is attached to the support member 83. Furthermore, the amount of warping of the blade spring member 82 is determined according to the fixed position at which the contact member 81 is fixed to the blade spring member 82. The warping of the blade spring member 82 brings the contact member 81 into contact with the photoreceptor 1 at predetermined pressure so that the contact member 81 scratches and removes the remaining transfer toner adhering to the surface of the photoreceptor 1 after a primary transfer. The length of the contact member 81 in a direction of the axis of the photoreceptor 1 has a range equal to or longer than the image forming region, and thus the contact member 81 scratches and removes the remaining transfer toner over the whole region of the photoreceptor 1 in the direction of the axis of the photoreceptor 1.

The remaining transfer toner is removed from the photoreceptor 1 with the cleaning blade 8, and taken into the housing 711, and contained in the toner waste containing box (not illustrated) with the conveyance screw 712.

Figure 3:
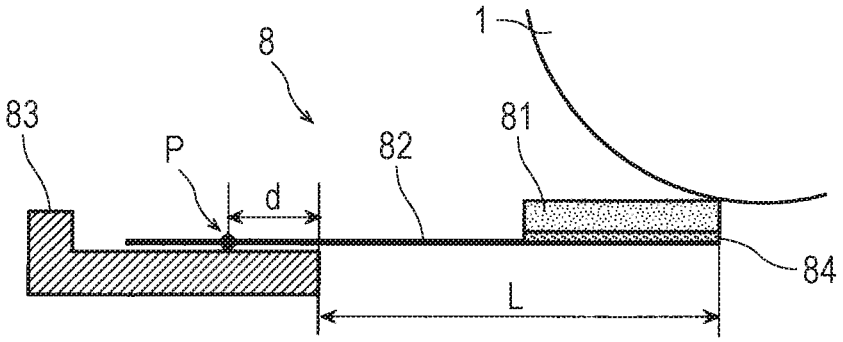
FIG. 3 is a schematic diagram of a configuration of a cleaning blade according to an embodiment of the present invention.

FIG. 3 is a schematic diagram of a configuration of the cleaning blade 8 according to an embodiment of the present invention. Note that, although the blade spring member 82 of the cleaning blade 8 illustrated in FIG. 3 does not warp, the blade spring member 82 actually warps because predetermined pressure is applied to the contact member 81 in contact with the image carrier. The same goes for the other drawings to be described.

As the material of the elastic contact member 81 included in the cleaning blade 8, urethane rubber, which has been used in common, is also used preferably in the present embodiment. Note that, differently from existing contact members, the contact member 81 of the cleaning blade 8 according to an embodiment of the present invention does not require a supporting function or a function for giving contact force. Thus, materials different from the materials which have been used, for example, materials with high abrasion resistance and ozone resistance such as fluorine rubber (FKM), styrene-butadiene rubber (SBR), and acrylonitrile rubber (NBR) may be used for the contact member 81. The contact member 81 preferably has a thickness approximately equal to or thicker than 0.5 mm and equal to or thinner than 2.0 mm. In addition, it is preferable in general that the rectangular contact member 81 has a lateral length approximately equal to or more than 5 mm and equal to or less than 10 mm. Needless to say, the lateral length may be longer than the length. If the contact member 81 is formed by molding, the contact member 81 may further be thinner and shorter in thickness and length.

The blade spring member 82 of the cleaning blade 8 is made, for example, of a material such as stainless steel or phosphor bronze, which have high corrosion resistance. In particular, stainless steel is preferable because of its high strength and less fatigue. To ensure that the cleaning blade 8 appropriately moves along the photoreceptor 1, it is preferable that the blade spring member 82 has a thickness approximately equal to or thicker than 0.05 mm and equal to or thinner than 0.1 mm. The Young's modulus for the blade spring member 82 is preferably equal to or more than 98 GPa and equal to or less than 206 GPa. The fixed position at which the blade spring member 82 is fixed on the support member 83 is preferably determined in consideration of the Young's modulus and thickness of the blade spring member 82.

The support member 83 of the cleaning blade 8 is made, for example, of a steel sheet such as an electro galvanized steel sheet (SECC). To ensure the strength capable of preventing the cleaning blade 8 from deforming, for example, due to pressure or external force applied to the cleaning blade 8, and capable of keeping the straightness of the edge of the cleaning blade 8 as specified, the support member 83 preferably has a thickness equal to or thicker than 1.6 mm and equal to or thinner than 2.0 mm.

For example, an adhesive 84 (illustrated in FIG. 3) is used to attach the contact member 81 to the first end of the blade spring member 82. A hot-melt adhesive with heat plasticity is preferably used as the adhesive 84. Alternatively, a double-faced adhesive tape can also be used, but such a double-faced adhesive tape makes it difficult to keep the straightness of the cleaning blade 8 because the blade spring member 82 is thin. Note that a method for attaching the contact member 81 to the blade spring member 82 may be molding in which the contact member 81 is integrated with the blade spring member 82. The adhesive 84 is not required for such a molding method. As illustrated in FIG. 3, the attachment position at which the contact member 81 is attached to the blade spring member 82 is preferably determined so that a first edge of the contact member 81 nearer to the photoreceptor 1 is aligned to the edge of the free first end of the blade spring member 82. If it is difficult to adjust the attachment position to such a position, the first end of the blade spring member 82 may protrude outwardly from the first edge of the contact member 81. However, it is necessary in such a case to prevent the first end of the blade spring member 82 from being in contact with the photoreceptor 1. Alternatively, the first edge of the contact member 81 nearer to the photoreceptor 1 may protrude from the edge of the free first end of the blade spring member 82. However, in such a case, if the protrusion length of the contact member 81 from the blade spring member 82 is long, the protruding part of the contact member 81 is extremely deformed, and this deformation reduces the contact pressure with time. This hinders the good effect on the permanent deformation. Thus, the protrusion length of the contact member 81 from the blade spring member 82 may properly be determined in consideration of the thickness of the contact member 81, and it is preferable in general that the protrusion length is approximately equal to or shorter than 0.5 mm.

To fix the second end of the blade spring member 82 on the support member 83, for example, the publicly known spot welding, screwing, or adhesive may be used. However, spot welding is preferable in terms of strength or performance. As illustrated in FIG. 3, if the welded and fixed position is a point P, a protrusion length L (mm) of the blade spring member 82 from a first edge (top) of the support member 83 nearer to the photoreceptor 1 is a parameter to determine the contact pressure applied on the first edge of the contact member 81, similarly, for example, to the thickness of the blade spring member 82, the Young's modulus for the blade spring member 82, and the depth of the bite of the blade spring member 82.

A distance d from the first edge of the support member 83 to the fixed point P is a parameter that affects the contact pressure. A long distance d increases a range within which the blade spring member 82 can freely be deformed between the first edge of the support member 83 and the fixed point P. This increase decreases the contact pressure of the contact member 81 applied on the photoreceptor 1. However, the contact pressure is decreased only when the photoreceptor 1 stops rotating. The contact pressure when the photoreceptor 1 drives will be described below. The blade spring member 82 may warp also in the range of the distance d. Thus, the distance d also affects an effective contact angle of the contact member 81 with the photoreceptor 1. As described above, the distance d affects the contact pressure and contact angle of the contact member 81, and thus the inventors examined the distance d and have found two problems described below.

Figure 4A:
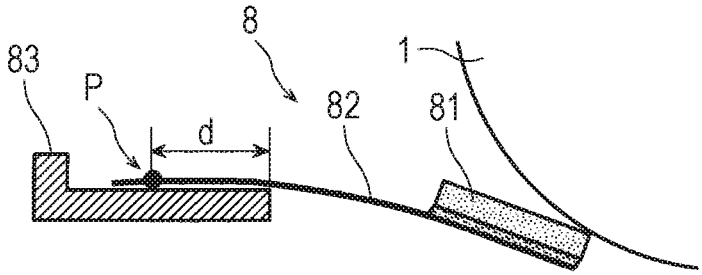
FIG. 4A is a diagram of a contact state in which the cleaning blade is in contact with a photoreceptor 1 while the photoreceptor stops and FIG. 4B is a diagram of a contact state in which the cleaning blade is in contact with a photoreceptor 1 while the photoreceptor 1 drives.
Figure 4B:
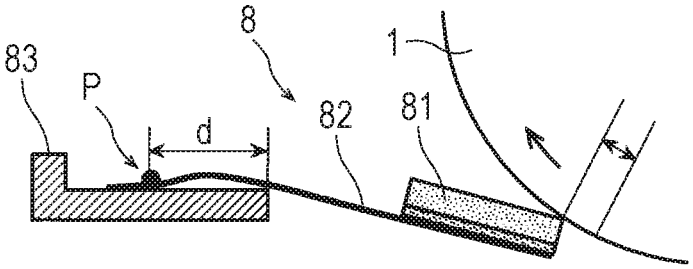

The first problem (problem 1) is that a long distance d increases the torque of the photoreceptor 1, and thus reduces the life of the photoreceptor 1. FIG. 4A illustrates a contact state when the contact member 81 is in contact with the photoreceptor 1 while the photoreceptor 1 stops. FIG. 4B illustrates a contact state when the contact member 81 is in contact with the photoreceptor 1 while the photoreceptor 1 rotates and drives. If the distance d is long and the photoreceptor 1 rotates and drives, the blade spring member 82 warps between the first edge of the support member 83 and the fixed point P. Thus, the contact position at which the contact member 81 is in contact with the photoreceptor 1 is pulled toward the downstream of the rotation of the photoreceptor 1. This increases the contact pressure of the contact member 81 applied on the photoreceptor 1. This also increases the effective contact angle when the photoreceptor 1 rotates and drives. The increased contact force and the increased effective contact angle increase the peak pressure applied on the first edge of the contact member 81, and thus increase the torque of the photoreceptor 1. Then, the increased torque increases the electricity required for the motor, and thus increases the size and cost of the device. In addition, the increased contact pressure of the contact member 81 wears the photoreceptor 1 more for each travel distance, and thus reduces the life of the photoreceptor 1.

Figure 5A:
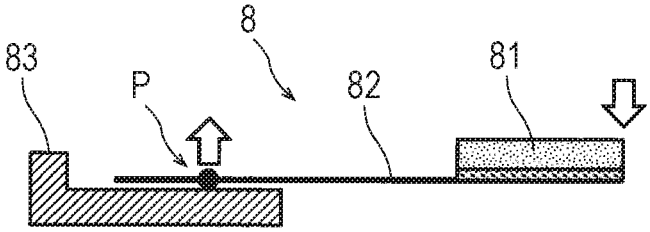
FIG. 5A is a diagram describing the force applied on a fixed point when a distance has a predetermined length and FIG. 5B is a diagram describing the force applied on the fixed point when the distance has a short length.
Figure 5B:
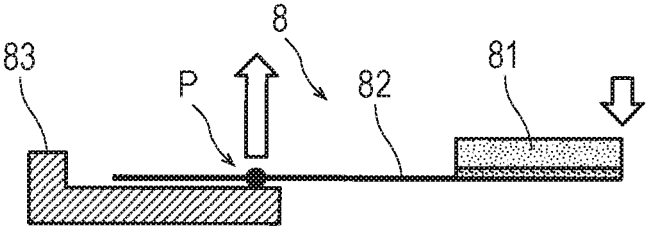

The second problem (problem 2) is the separation of the fixed part or the damage to the blade spring member, which occurs when the distance d is short. FIG. 5A illustrates the force applied on the fixed point P when the distance d has a predetermined length. FIG. 5B illustrates the force applied on the fixed point P when the distance d is short. When the distance d is short, strong force is applied on the fixed point P because of the principle of leverage in comparison with the force applied when the distance d has the predetermined length. This causes the problem that the fixed part is peeled. If fixing the fixed part more strongly in order to make it difficult to peel the fixed part, the strong fixing gives a load on the blade spring member 82 at the first edge of the support member 83. The blade spring member 82 is deformed beyond its yield point and damaged.

In order to solve the two problems, the inventors examined the distance d intensely, and have found that the distance d also affects the function controlled by the protrusion length L of the blade spring member 82 from the support member 83, and that the distance d is specified according to the relationship with the protrusion length L, and finally invented an embodiment of the present invention.

Figure 6:
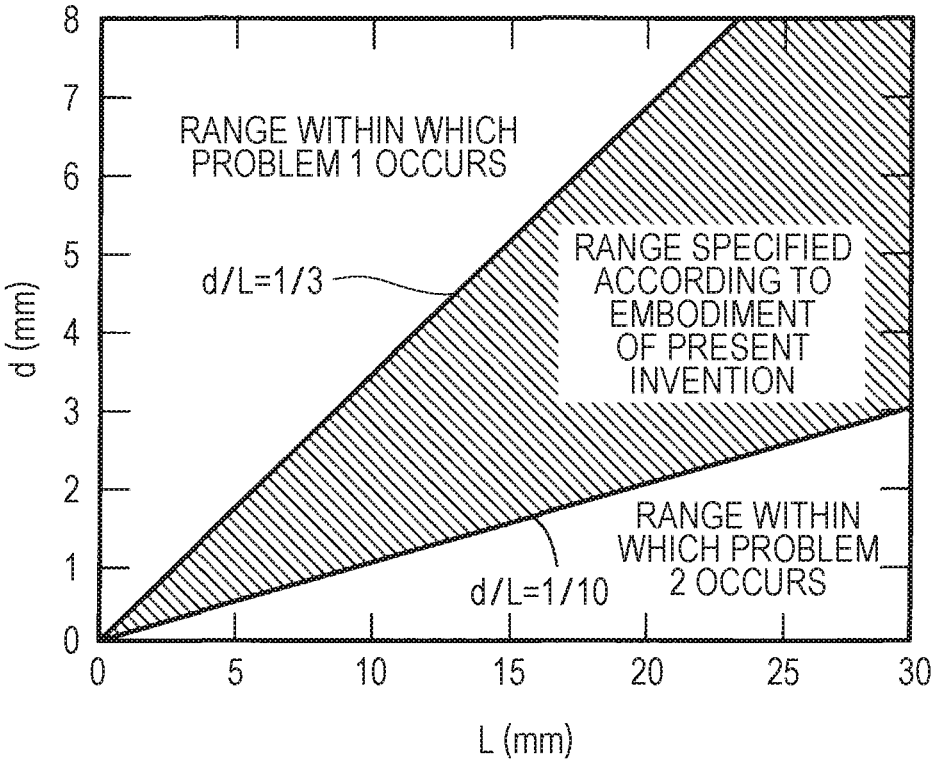
FIG. 6 is a graph of a specified range of the distance and a free length according to an embodiment of the present invention.

A main feature of an embodiment of the present invention is to maintain d/L at a value equal to or more than 1/10 and equal to or less than 1/3. A d/L larger than 1/3 causes the problem 1. In other words, the rotation of the photoreceptor 1 warps the blade spring member 82 between the first edge of the support member 83 and the fixed point P, and pulls the contact position at which the contact member 81 is in contact with the photoreceptor 1 toward the downstream of the rotation of the photoreceptor 1. This increases the contact pressure at which the contact member 81 is in contact with the photoreceptor 1 and also increases the effective contact angle when the photoreceptor 1 rotates. This increase increases the torque of the photoreceptor 1 and reduces the life of the photoreceptor 1. On the other hand, a d/L smaller than 1/10 causes the problem 2. In other words, the fixed part of the blade spring member 82 fixed on the support member 83 is peeled or the blade spring member 82 is damaged. FIG. 6 illustrates the range of d/L specified in an embodiment of the present invention. FIG. 6 illustrates a vertical axis as the distance d (mm), a horizontal axis as the protrusion length (mm), and a range shaded with oblique lines as the range of d/L specified in an embodiment of the present invention. The problem 1 occurs in the range upper than the shaded range. The problem 2 occurs in the range lower than the shaded range.

The positions of the blade spring member 82 and the support member 83 in a direction of the axis of the photoreceptor 1 (in a longitudinal direction) are not especially limited. However, when the blade spring member 82 is fixed on the support member 83 with spots by spot welding and the interval between the fixed spots is wide in the longitudinal direction, the contact pressure decreases in the parts that are not fixed and unevenness in contact pressure may be developed. Thus, it is preferable in such a case that the longitudinal interval is equal to or shorter than 20 mm. On the other hand, a longitudinal interval equal to or shorter than 2 mm may cause waves on the blade spring. Thus, it is preferable that the longitudinal interval is equal to or wider than 2 mm. Alternatively, when the blade spring member 82 is fixed on the support member 83, for example, with an adhesive, the blade spring member 82 may be fixed on the support member 83 at predetermined intervals in the longitudinal direction as the spot welding described above, or the blade spring member 82 may be fixed on the support member 83 with an adhesive as a line over the longitudinal length of the blade spring member 82.

The distance d is not especially limited. However, for example, the distance d is preferably equal to or longer than 1.5 mm when spot welding is used to fix the blade spring member 82 on the support member 83. This is because the spot welded position near the first edge of the support member 83 makes it difficult to evenly weld the blade spring member 82.

If the image carrier is an ordinary photoreceptor such as an organic photoreceptor, the life of the imaging unit is determined depending on the wearing of the light-sensitive layer of the photoreceptor. Thus, the contact pressure of the cleaning blade 8 on the photoreceptor 1 is important. A major factor to determine the contact pressure of the cleaning blade 8 is the protrusion length L of the blade spring member 82. The protrusion length L of the blade spring member 82 from the first edge of the support member 83 is preferably within a range equal to or longer than 10 mm and equal to or shorter than 20 mm. Maintaining the protrusion length L of the blade spring member 82 within the range prevents the photoreceptor 1 from wearing and prevents the torque of the photoreceptor 1 from increasing.

Alternatively, when the photoreceptor is provided with a protection layer that prevents the light sensitive layer from wearing on the surface of the photoreceptor, or the photoreceptor is made of a high hardness material such as amorphous silicon, specifically, when the outermost layer of the photoreceptor has a universal hardness HU equal to or more than 200 $N/mm^2$ and equal to or less than 350 $N/mm^2$, it is preferable to maintain the protrusion length L of the blade spring member 82 within a range equal to or longer than 6 mm and equal to or shorter than 18 mm in order to increase the contact pressure of the cleaning blade 8 on the photoreceptor 1 and increase the cleaning capability of the cleaning blade 8.

On the other hand, when the image carrier is the transfer belt 5 (illustrated in FIG. 1), toner images of four colors are overlaid on the transfer belt 5. This increases the amount of toner remaining on the surface of the transfer belt 5 after the secondary transfer. In order to maintain the cleaning capability, the contact pressure of the cleaning blade 8 on the transfer belt 5 is preferably set at a high value in comparison with the contact pressure when the image carrier is a photoreceptor. In this case, the protrusion length L of the blade spring member 82 from the first edge of the support member 83 is preferably within a range equal to or longer than 8 mm and equal to or shorter than 18 mm. Note that the transfer belt 5 needs to be made of resin but, for example, the type of resin, and the thickness, perimeter, and hardness of the belt are not especially limited. Furthermore, the transfer belt 5 may have a coated surface.

If the transfer belt 5 has an elastic layer, this makes it easy to pull the contact member 81 of the cleaning blade 8 toward the downstream of the rotation of the transfer belt 5. This may increase the contact pressure and effective contact angle of the contact member 81 on the transfer belt 5. Thus, the d/L is preferably equal to or more than 1/10 and equal to or less than 1/5. In addition, the protrusion length L of the blade spring member 82 from the first edge of the support member 83 is preferably within a range equal to or longer than 12 mm and equal to or shorter than 16 mm. Note that the transfer belt 5 needs to have an elastic layer but, for example, the type, thickness, and hardness of the elastic layer, and the thickness and perimeter of the belt are not especially limited. Furthermore, the transfer belt 5 may have a coated surface.

In consideration, for example, of the size and contact pressure of the cleaning blade 8, it is preferable that the cleaning blade 8 has a structure in which the Young's modulus for the blade spring member 82 is equal to or more than 180 GPa and equal to or less than 206 GPa, the blade spring member 82 has a thickness equal to or thicker than 70 μm and equal to or thinner than 90 μm, and the protrusion length L of the blade spring member 82 from the first edge of the support member 83 is equal to or longer than 12 mm and equal to or shorter than 16 mm.

The cleaning blade 8 according to the embodiment described above is provided in a direction counter to the direction in which the photoreceptor 1 rotates. However, the cleaning blade 8 may be provided in a direction in which the cleaning blade 8 trails the rotation of the photoreceptor 1. As for the distance d, the lengthened distance d has an advantage that the contact pressure when the image carrier stops rotating is decreased. However, in order to maintain the d/L within the range specified in an embodiment of the present invention, it is also necessary to lengthen the protrusion length L. This increases the size of the cleaning blade 8. Thus, the distance d is preferably set at a length equal to or shorter than 5 mm in practical terms.

EXEMPLARY EMBODIMENT (Assessments of the Torque of the Photoreceptor Drum, the Separation of the Fixed Part of the Blade Spring Member Fixed on the Support Member, the Deformation of the Blade Spring Member, and the Damage to the Blade Spring Member)

Figure 7:
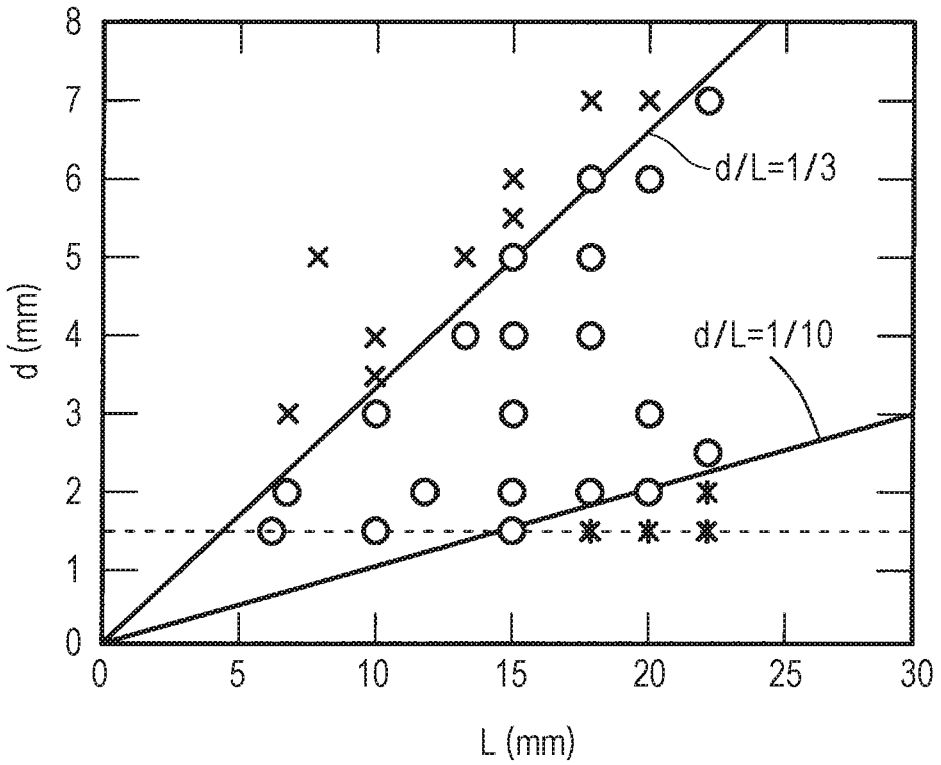
FIG. 7 is a graph of the assessment results of the torque of the photoreceptor, and the deformation of the blade spring member and the damage to the blade spring member.

A cleaning blade was installed on a photoreceptor drum unit. The torque of the photorecceptor drum while the photoreceptor drum rotates was measured. At the same time, it was confirmed whether the separation of the fixed part of the blade spring member fixed on the support member, the deformation of the blade spring member, and the damage to the blade spring member occurred. An image forming apparatus used in an experiment for these measurement and confirmation is a "bizhub C284e" manufactured by KONICA MINOLTA, INC. of which photoreceptor drum unit is modified so that the cleaning blade can be installed on the photoreceptor drum unit. The torque of the photoreceptor drum while the photoreceptor drum rotates was measured with an external drive jig including a torque converter. The separation of the fixed part of the blade spring member fixed on the support member, the deformation of the blade spring member, and the damage to the blade spring member were observed and assessed with the following criteria by visually comparing the conditions of the cleaning blade when the cleaning blade was attached with the conditions of the cleaning blade after the cleaning blade drove. The experiment was conducted in the conditions in which a brand-new photoreceptor drum was used in a hot and humid environment (30° C. and 85%) that was more likely to increase the torque and cause damage. FIG. 7 illustrates the assessment results.

Cleaning blades with different distances d (mm) from the first edge of the support member to the fixed position of the blade spring member and different protrusion lengths L (mm) of the blade spring member from the first edge of the support member were prepared and assessed. The materials, shapes, etc. of the contact member, the blade spring member, and the support member will be described below.

The contact member: is made of urethane rubber, and has a thickness of 2 mm, a lateral length of 5 mm, and a longitudinal length of 340 mm.

The blade spring member: is an SUS304, and has a thickness of 80 μm and a longitudinal length of 340 mm.

The support member is an SECC steel sheet, and has a thickness of 2 mm and a longitudinal length 340 mm.

The method for fixing the contact member on the blade spring member: is a hot-melt adhesive, and the whole contact member is fixed.

The method for fixing the blade spring member on the support member: is spot welding, and the spots are welded at 4 mm intervals in the longitudinal direction (2 mm distance away from the longitudinal end)

The setting conditions: are a contact pressure of 30 N/m and an effective contact angle (θ) of 15°

The photoreceptor drum: is an organic photoreceptor (without a protection layer)

(Assessment Criteria of the Torque, the Separation of the Fixed Part of the Blade Spring Member Fixed on the Support Member, the Deformation of the Blade Spring Member, and the Damage to the Blade Spring Member)

The symbol ○: means that the torque is within the specified range, and no damage occurs.

The symbol x: means that the torque is high beyond the specified range.

The symbol *: means that damage occurs (the damage is the separation of the fixed part and the deformation of the blade spring member).

Note that, although the specified range of the torque is determined, for example, according to the structure of the motor or the unit of each product, this assessment uses the specifications generally used for copying machines and image forming apparatuses as the assessment criteria.

As illustrated in FIG. 7, the torque of the photoreceptor drum increased within a range of $d/L>1/3$. On the other hand, the separation of the fixed part of the blade spring member fixed on the support member, the deformation of the blade spring member, and the damage to the blade spring member occurred within a range of $d/L<1/10$. Note that the fixed part was not peeled and the blade spring member was deformed because an SUS304 with a thin thickness (of 80 μm) was used as the blade spring member.

Experiments similar to this experiment were conducted separately from this experiment while the thickness of the blade spring member was changed. The fixed part was not peeled and the blade spring member was deformed in the experiment using a blade spring member with a thin thickness, similarly to the blade spring member with a thickness of 80 μm. On the other hand, when a blade spring member with a thick thickness was used, the fixed part was peeled. Note that the problems occurred in the same ranges of d/L as illustrated in FIG. 7 even when the thickness of the blade spring member was changed. Similarly, the problems occurred in the same ranges of d/L as illustrated in FIG. 7 even when the material of the blade spring member was changed.

(Durability Assessment)

Figure 8:
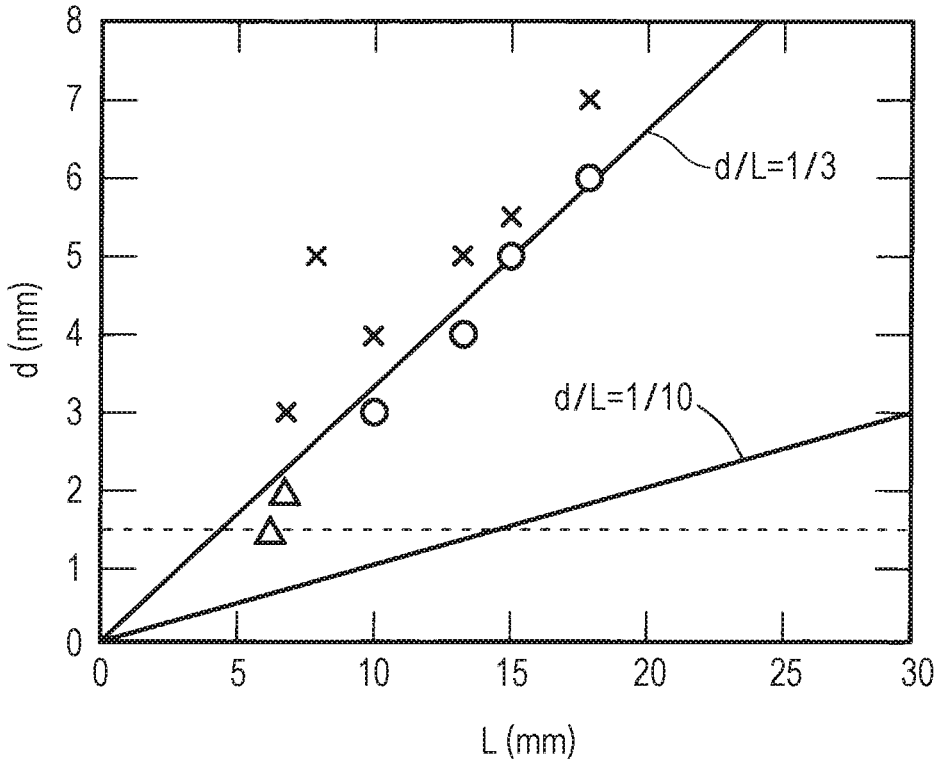
FIG. 8 is a graph of the assessment results of durability.

The amount of wearing of the contact member of the cleaning blade and the amount of wearing of the photoreceptor drum wore were measured and assessed with the criteria described below. An experiment for the assessment used a "bizhub C284e" manufactured by KONICA MINOLTA, INC. Photoreceptor drum units similar to the drum unit used in the assessment experiment described above were used. One of the photoreceptor drums was the same organic photoreceptor (without a protection layer) as the drum used in the assessment experiment described above. The other photoreceptor drum was an organic photoreceptor with a protection layer. Cleaning blades with different distances d (mm) from the first edge of the support member to the fixed position of the blade spring member and different protrusion lengths L (mm) of the blade spring member from the first edge of the support member were prepared and assessed. However, the assessments were conducted with the following criteria under the conditions narrowed around a range satisfying d/L=⅓ in which the contact pressure of the cleaning blade increased while the photoreceptor drum rotates. FIG. 8 illustrates the assessment results.

(Conditions for the Durability Assessments)

The setting conditions: are a contact pressure of 30 N/m and an effective contact angle (θ) of 15°.

The durability conditions: are 50,000 prints, two-sheet intermittent printing, and a coverage rate of 5% in an environment (of a temperature of 23° C. and a humidity of 55%).

(Durability Assessment Criteria)

Life (Abrasion of the Photoreceptor and the Blade)

The symbol ○: means the abrasion with which both of the photoreceptor with a protection layer and the photoreceptor without a protection layer last satisfactorily beyond the desired life.

The symbol Δ: means the abrasion with which the photoreceptor with a protection layer lasts satisfactorily beyond the desired life and the photoreceptor without a protection layer lasts until the end of the desired life.

The symbol x: means the abrasion that reaches the abrasion limit before both of the photoreceptor with a protection layer and the photoreceptor without a protection layer reach the desired life.

Note that the abrasion limit used as an assessment criterion in this experiment is the amount of abrasion of the cleaning blade in which faulty cleaning starts, or the amount of abrasion of the photoreceptor drum that causes a problem, for example, that the photoreceptor drum fails to regulate the electric potential of the photoreceptor for charging or exposing within a range satisfying the specifications, and thus causes the image to be faulty.

As illustrated in FIG. 8, the abrasion with the durability (abrasion resistance) within the range of d/L>⅓ reached the abrasion limit before the photoreceptors reach the desired life. This happened to both of the photoreceptors regardless of the presence or absence of a protection layer. On the other hand, the durability within the range of d/L≤⅓ was high enough to satisfy the desired life. However, when the photoreceptor drum without a protection layer had a short protrusion length L of the blade spring member from the first edge of the support member and the unevenness of the contact pressure of the cleaning blade increased, the photoreceptor drum lasted until the end of the desired life but sometimes not satisfactorily beyond the desired life.

(Assessments of the Transfer Belt)

To assess the transfer belt, the torque was measured, and the separation of the fixed part of the blade spring member fixed on the support member, the deformation of the blade spring member, the damage to the blade spring member, and the durability were assessed.

The assessment results were similar to the assessment results of the photoreceptor drum.

According to an embodiment of the present invention, the cleaning blade does not cause the increase in torque of the image carrier and the reduction in life of the image carrier, does not cause the separation of the blade spring from the support member and the damage to the blade spring, and can reduce the permanent deformation of the contact member.

Although embodiments of the present invention have been described and illustrated in detail, it is clearly understood that the same is by way of illustration and example only and not limitation, the scope of the present invention should be interpreted by terms of the appended claims.

What is claimed is:

1. A cleaning blade that removes a substance adhering to a surface of a rotating image carrier, the cleaning blade comprising:

a contact member that is formed into a rectangular shape with a width corresponding to a length perpendicular to a rotation direction in which the image carrier rotates and has elasticity for removing the substance adhering to the surface of the image carrier by sliding on the surface of the image carrier;

a blade spring member that is provided with the contact member on a first end of a first surface of the blade spring member and that presses the contact member onto the surface of the image carrier; and a support member that fixes and supports a second end of the blade spring member, wherein:

the blade spring member protrudes from a first edge of the support member by a protrusion length of L (mm), the blade spring member has a thickness equal to or thicker than 50 μm and equal to or thinner than 100 μm, the contact member does not overlap with the support member along a thickness direction of the contact member, the first surface of the blade spring member includes an area in which the contact member is not provided, the area being between the first edge of the support member and a side of the contact member closest to the first edge of the support member, and when a distance on the support member from the first edge of the support member to a fixed point at which the blade spring member is fixed on the support member is d (mm), the protrusion length L of the blade spring member from the first edge of the support member is equal to or longer than 12 mm and equal to or shorter than 16 mm and a following inequality (1) holds:

$$\frac{1}{10} \leq d/L \leq \frac{1}{3} \quad (1).$$

2. The cleaning blade according to claim 1, wherein spot welding is used to fix the blade spring member on the support member.

3. The cleaning blade according to claim 2, wherein an interval between spots fixed in the spot welding along a direction corresponding to a longitudinal direction of the image carrier is equal to or wider than 2 mm and equal to or shorter than 20 mm.

4. The cleaning blade according to claim 3, wherein the interval is 4 mm.

5. The cleaning blade according to claim 1, wherein the distance d is equal to or longer than 1.5 mm.

6. The cleaning blade according to claim 1, wherein the image carrier is a photoreceptor.

7. The cleaning blade according to claim 6, wherein a surface of the photoreceptor has a universal hardness HU equal to or more than 200 $N/mm^2$ and equal to less than 350 $N/mm^2$.

8. The cleaning blade according to claim 1, wherein the image carrier is a transfer belt made of resin.

9. The cleaning blade according to claim 1, wherein the image carrier is a transfer belt with an elastic layer.

10. The cleaning blade according to claim 1, wherein:

a Young's modulus for the blade spring member is equal to or more than 180 GPa and equal to or less than 206 GPa, and the thickness of the blade spring member is equal to or thicker than 70 μm and equal to thinner than 90 μm.

11. An image forming apparatus comprising at least:

an image carrier, and a cleaning blade that removes a substance adhering to a surface of the image carrier, wherein the cleaning blade according to claim 1 is used as the cleaning blade.

* * * * *